US005299539A

United States Patent [19]

Kurihara

[11] Patent Number: 5,299,539

[45] Date of Patent: Apr. 5, 1994

[54] METHOD FOR CONTROLLING ROTATIONAL SPEED OF AN INTERNAL COMBUSTION ENGINE

[75] Inventor: Kazumasa Kurihara, Higashimatsuyama, Japan

[73] Assignee: Zexel Corporation, Tokyo, Japan

[21] Appl. No.: 35,391

[22] Filed: Mar. 18, 1993

[30] Foreign Application Priority Data

Mar. 23, 1992 [JP] Japan ..... 4-094876

[51] Int. Cl.[5] ..... F02M 31/00

[52] U.S. Cl. ..... 123/357

[58] Field of Search ..... 123/352, 357, 358, 359

[56] References Cited

U.S. PATENT DOCUMENTS

| | | | |
|---|---|---|---|
| 4,667,560 | 6/1987 | Cao et al. | 123/357 |
| 4,667,633 | 5/1987 | Stumpp et al. | 123/357 |
| 4,690,114 | 9/1987 | Weischedel | 123/357 |
| 5,067,461 | 11/1991 | Joachim et al. | 123/358 |
| 5,085,190 | 2/1992 | Birk et al. | 123/357 |
| 5,111,789 | 5/1992 | Moriya et al. | 477/218 |

FOREIGN PATENT DOCUMENTS 60-179365 9/1985 Japan .

*Primary Examiner*—Raymond A. Nelli
*Assistant Examiner*—Thomas N. Moulis
*Attorney, Agent, or Firm*—Pollock, Vande Sande & Priddy

[57] ABSTRACT

In an engine speed controlling method in a PI isochronous control mode, the initial value of an integral term for PI control is determined when the difference between a given target engine speed and an actual engine speed becomes more than a prescribed level, and the value of the integral term is change to the value of a no-load rack position at which the target engine speed is maintained in no engine load condition, when the actual engine speed becomes equal to the target engine speed, whereby large overshoot and undershoot can be effectively suppressed.

5 Claims, 5 Drawing Sheets

METHOD FOR CONTROLLING ROTATIONAL SPEED OF AN INTERNAL COMBUSTION ENGINE

BACKGROUND OF THE INVENTION

1. Field of the Invention

The present invention relates to a method for controlling rotational speed of an internal combustion engine in an isochronous control mode using a proportional and integral (PI) control.

2. Prior Art

For example, in a vehicle powered by an internal combustion engine equipped with an electronically controlled automatic transmission system in which the operations of a gear-type transmission and a clutch are controlled by means of a microcomputer, for shifting the gear-type transmission into a desired gear position it is necessary to synchronize rotational speeds between two gears to be meshed in the transmission (Japanese Patent Application Public Disclosure No. Sho 60-179365). To establish such a synchronization between the gears, an isochronous control is usually employed, and a fuel quantity to be supplied to an internal combustion engine is controlled by the use of PI control in order to make an actual rotational speed of a gear coincident with a desired target rotational speed thereof.

However, when the rotational speed of the internal combustion engine is controlled in PI control mode, it tends to degrade the response characteristics of the control for the variation of the target rotational speed. In this case, the improvement in the response characteristics will impair control stability. Furthermore, an overshoot or undershoot condition in engine rotational speed may be caused when the target rotational speed varies greatly for a short time. Therefore, it is generally said that PI control is unsuitable where the target rotational speed differs greatly from the actual rotational speed and it is required to make the actual rotational speed equal to the target rotational speed for a short time, for example in the above example of the synchronization control of the gear rotational speed for the gear-shifting operation of the above-mentioned transmission system.

SUMMARY OF THE INVENTION

It is therefore an object of the present invention to provide an improved method for controlling rotational speed of an internal combustion engine in an isochronous control mode employing PI control.

It is another object of the present invention to provide a rotational speed control method for an internal combustion engine in a PI isochronous control mode, in which both of response characteristics and stabilization characteristics can be satisfied at the same time even if the target rotational speed differs greatly from the actual rotational speed.

According to the present invention, in a method for controlling a rotational speed of an internal combustion engine in which a target position of a fuel regulating member for regulating a fuel quantity to be supplied to the engine is calculated in response to a given target engine speed and actual engine speed of the internal combustion engine, said target position being necessary for making the actual engine speed equal to the target engine speed by a PI isochronous control, the method comprises a first discriminating step for discriminating whether or not a difference between the target engine speed and the actual engine speed is more than a prescribed value, an initial value determining step for determining an initial value of an integral term for the PI isochronous control on the basis of the difference between the target engine speed and the actual engine speed when it is discriminated that the difference between the target engine speed and the actual engine speed has changed by more than the prescribed value in response to said first discriminating step, a second discriminating step for discriminating whether or not the actual engine speed is made substantially equal to the target engine speed by the PI isochronous control carried out by the use of the initial value determined in said initial value determining step, and a step for changing a value of the integral term to a value substantially equal to a value of a no-load rack position of the fuel regulating member at which a fuel quantity necessary for maintaining the rotational speed of the engine with no-load at the target engine speed is supplied to the engine, when it is discriminated in said second discriminating step that the actual engine speed is made substantially equal to the target engine speed.

Consequently, when the difference between the target and actual engine speed becomes a level which will cause the problems of undershoot or overshoot because of, for example, an updating of the target engine speed, the initial value of the integral term for a PI control is determined on the basis of the updated target engine speed and the actual engine speed. The initial value may be determined so as to, for example, improve the response characteristic of the engine speed control. To achieve this, the initial value of the integral term should be determined so as to obtain the same effect as that obtained by the increase in the gain of the PI control. That is, a large value should be selected as the initial value when the increase of the engine speed is required. On the other hand, a small value should be selected as the initial value when the decrease of the engine speed is required. When the actual engine speed becomes substantially equal to the target engine speed by the PI control by the use of the value of the integral term determined above, the value of the integral term is changed to the value according to the no-load rack position, whereby large overshoot and undershoot can be effectively suppressed owing to the fact that the torque for increasing or decreasing the engine speed becomes zero.

The invention will be better understood and other objects and advantages thereof will be more apparent from the following detailed description of preferred embodiments with reference to the drawings.

DETAILED DESCRIPTION OF THE PREFERRED EMBODIMENT

Figure 1:
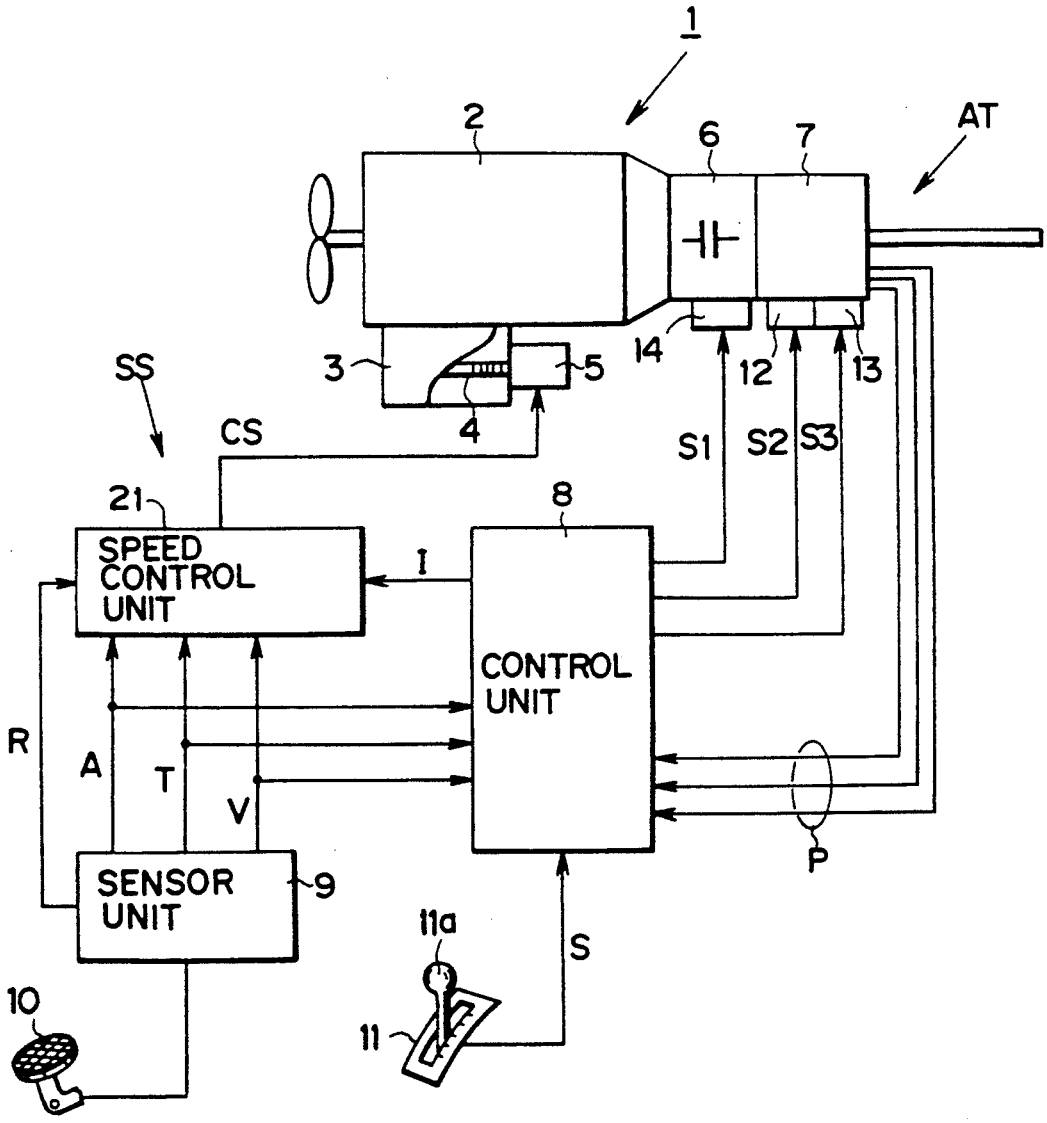
FIG. 1 is a schematic view illustrating an embodiment of a vehicular control system in which an engine speed is controlled in accordance with the present invention.

FIG. 1 is a schematic view showing an embodiment of a vehicular control system in which an isochronous engine speed control is carried out by the use of a PI control (which will be referred to as a PI isochronous control) in accordance with the present invention. In a vehicular control system 1 of FIG. 1, a diesel engine 2 is for powering a vehicle (not shown) and fuel is supplied to the engine 2 from a fuel injection pump 3 provided with a fuel regulating rack 4 for regulating the amount of fuel to be injected to the engine 2. Reference numeral 5 represents a solenoid actuator for operating the fuel regulating rack 4. There is provided a friction type clutch 6 and a gear-type transmission 7 on the output side of the diesel engine 2 and a conventional automatic transmission system AT is formed by the association of the clutch 6, the transmission 7 and a control unit 8 as described below.

The control unit 8 is provided with a microcomputer and receives a set of position signals P, which is sent from a position sensor (not shown) incorporated in the transmission 7 and is an indication of the current gear-shifted position of the transmission 7. From a sensor unit 9, the control unit 8 receives an acceleration signal A showing the amount of operation of an accelerator pedal 10, a TDC pulse T indicating when a piston in a predetermined cylinder (not shown) of the diesel engine 2 has reached its top dead center, and a vehicle speed signal V indicative of the running speed of the vehicle powered by the diesel engine 2. A selector 11 has a selecting lever 11*a* for selecting a gear position of the transmission 7, and a selected position signal S indicative of the actual position of the selecting lever 11*a* is produced from a sensor (not shown) associated with the selecting lever 11*a* and is sent to the control unit 8.

The control unit 8 is responsive to these input signals P, A, V and S and the input pulse T to carry out the calculation necessary for performing the gear-shifting control, and outputs a first control signal S1 for controlling the engaging/disengaging operation of the clutch 6, and second and third control signals S2 and S3 for controlling the select and shift operations respectively, of the transmission 7. The transmission 7 is associated with a select actuator 12 responsive to the second control signal S2 for moving the gear in a selected direction and a shift actuator 13 responsive to the third control signal S3 for moving the gear in a shifted direction. The first control signal S1 is applied to a clutch actuator 14 for operating the clutch 6. The operation for automatically shifting the transmission 7 into a desired position is carried out in a known manner in response to the control signals S1 to S3 produced by the control unit 8.

The vehicle control system 1 is provided with an engine speed control system SS for electronically controlling the rotational speed of the diesel engine 2, in addition to the automatic transmission system AT employing the control unit 8. The engine speed control system SS has a speed control unit 21 that receives the acceleration signal A, the TDC pulse T, a rack position signal R indicating the position of the fuel regulating rack 4 and the vehicle speed signal V from the sensor unit 9.

Figure 2:
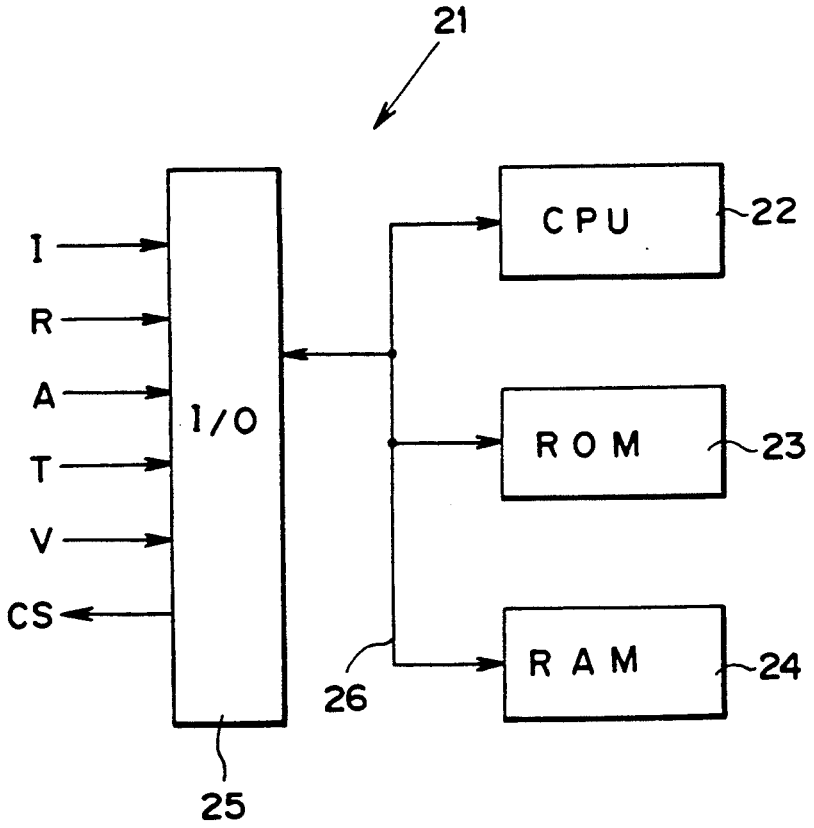
FIG. 2 is a block diagram of the speed control unit shown in FIG. 1.

As illustrated in FIG. 2, the speed control unit 21 is formed by the use of a conventional microcomputer system having a central processing unit (CPU) 22, a read-only memory (ROM) 23, a random access memory (RAM) 24, an input/output interface (I/0) 25, and a bus 26 for interconnecting them. A control program for controlling the engine speed of the diesel engine 2 is stored in the ROM 23 in advance and is executed in the CPU 22 to produce a speed control signal CS, which is applied to the solenoid actuator 5 for regulating the position of the fuel regulating rack 4.

As described later, the speed control unit 21 has not only a function for regulating the position of the fuel regulating rack 4 in accordance with prescribed governer characteristic in response to the operation of the accelerator pedal 10, but has also another function for controlling the engine speed so as to make the actual engine speed Na of the diesel engine 2 coincident with the target engine speed No requested at that time in a PI isochronous control manner according to the present invention in response to a command signal I produced by the control unit 8. The command signal I is for indicating that the transmission 7 is carrying out a required gear-shifting operation.

Figure 3:
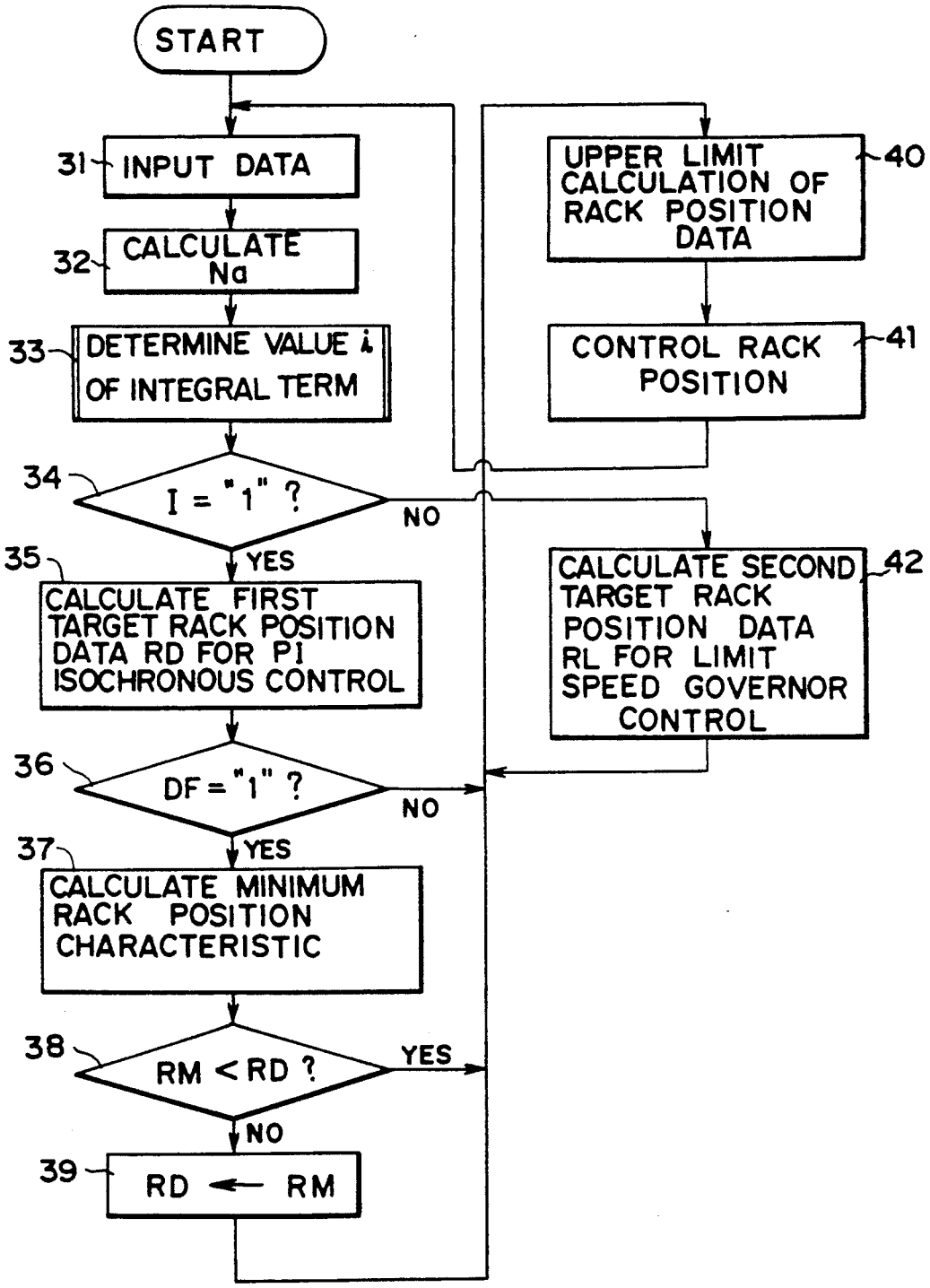
FIG. 3 is a flowchart of the execution of a speed control program in the speed control unit.

An explanation will be now given of the engine speed control operation in accordance with the speed control program stored in the ROM 23, with reference to FIG. 3. After the start of the execution of the speed control program, the operation moves to step 31 wherein data based on the signals applied from outside is input. Then, the operation moves to step 32 in which the actual engine speed Na of the diesel engine 2 is calculated from the time interval between TDC pulses T. In the next step 33 for determining a value of an integral term for a PI isochronous control operation, it is discriminated whether or not the command signal I is generated from the control unit 8 and the value of the integral term for PI isochronous control is determined in accordance with the present invention when the command signal I is produced.

Figure 4:
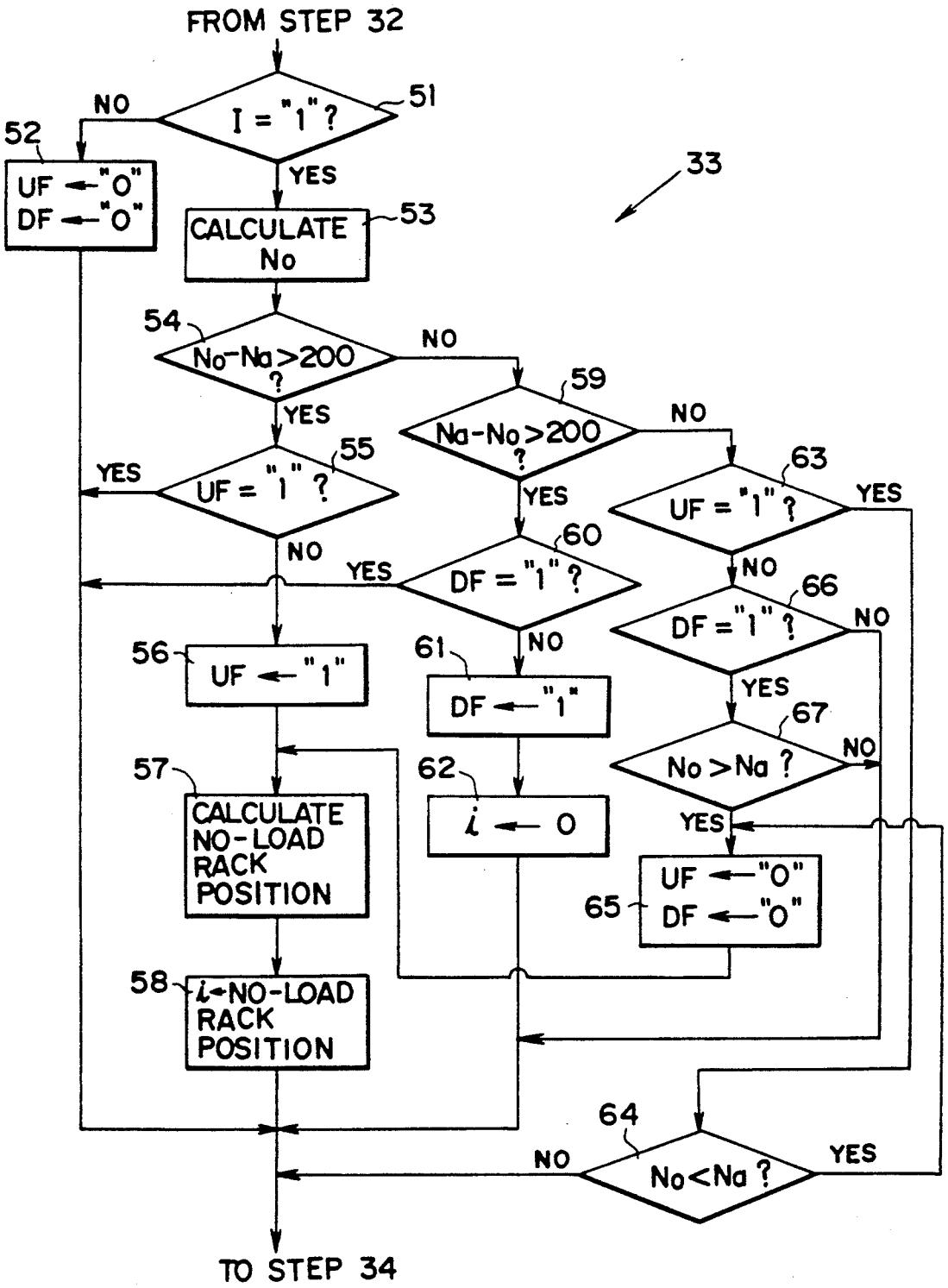
FIG. 4 is a detailed flowchart of a step for determining a value of an integral term for PI control.

Referring to FIG. 4, when the operation moves from step 32 to step 51, it is discriminated in step 51 whether or not the level of the command signal I is "1", in other words, whether or not the control for maintaining the rotational speed of the diesel engine 2 at a prescribed target value by the way of a PI isochronous control operation is requested. The discrimination in step 51 becomes NO when I="0", that is, when the PI isochronous control is not requested, and the operation moves to step 52, in which a flag UF indicating that the actual engine speed should be increased and a flag DF indicating that the actual engine speed should be decreased are made clear. Then, the operation moves to step 34 (FIG. 3).

The discrimination in step 51 becomes YES when I="1", that is, when the PI isochronous control is requested, and the operation moves to step 53, wherein the target engine speed No suitable for the operation condition of the vehicle at that time is calculated in a conventional manner on the basis of information from the sensor unit 9 and the control unit 8.

After this, the operation moves to step 54, wherein it is discriminated whether or not No−Na is greater than 200 (rpm) The discrimination in step 54 becomes YES when No−Na is greater than 200 (rpm), the operation moves to step 55, wherein a discrimination is made as to whether or not the flag UF is "1". The operation moves to step 34 when UF="1". In contrast, when UF="0", the flag UF is set in step 56 and the operation moves to step 57 to calculate a no-load rack position which is defined as a position of the fuel regulating rack 4 for no-load condition at that engine speed. Then, the operation moves to step 58 wherein the calculated value of the no-load rack position is set as the value i of the integral term for PI isochronous control and the operation moves to step 34. That is, the value of the no-load rack position is set as an initial value of the integral term, if the target engine speed is greater than the actual engine speed by more than 200 (rpm) and the flag UF is "0". In this case, the value of the maximum rack position may be set as the initial value of the integral term to accelerate the increase of the engine speed.

On the other hand, the operation moves to step 59 when the discrimination in step 54 is NO, and the discrimination is made in step 59 as to whether or not Na−No is greater than 200 (rpm). The discrimination in step 59 becomes YES when Na−No is greater than 200 (rpm), and the operation moves to step 60. The discrimination is made in step 60 as to whether or not DF is "1". When DF="0", the discrimination in step 60 becomes NO and the operation moves to step 61. Then, the flag DF is set in step 61 and the value i is set to zero in step 62. After this, the operation moves to step 34. The operation moves to step 34 without the execution of steps 61 and 62 when the determination in step 60 is YES. That is, in the case where the actual engine speed is higher than the target engine speed by more than 200 (rpm), the discrimination is made as to whether or not the flag DF is cleared, and the initial value of the integral term is set to zero if the flag DF is cleared.

When the discrimination in step 59 becomes NO, the operation moves to step 63 wherein the discrimination is made as to whether or not the flag UF is set. The discrimination in step 63 becomes YES when UF="1", and the discrimination is made in step 64 as to whether or not No is lower than Na. The operation moves to step 34 when it is discriminated in step 64 that No is higher than or equal to Na. On the other hand, in the case where No is lower than Na, the operation moves to step 65 wherein the flags UF and DF are cleared, and then, steps 57 and 58 are executed.

If it is discriminated in step 63 that UF is "0", the operation moves to step 66 wherein the discrimination is made as to whether or not DF is set. The discrimination in step 66 becomes NO when DF="0", and the operation moves to step 34. On the other hand, the discrimination in step 66 becomes YES when DF="1", and the operation moves to step 67, wherein a discrimination is made as to whether or not No is higher than Na. If No is higher than Na, the discrimination in step 67 becomes YES and the operation moves to step 65. On the other hand, the discrimination in step 67 becomes NO when No is lower than or equal to Na, and the operation moves to step 34. That is, in the case where the difference between No and Na is smaller than 200 (rpm), it follows that the value of the no-load rack position is set as the value i of the integral term when UF="1" and No is smaller than Na or when UF="1" and No is higher than Na. In other words, the value of the no-load rack position is set as the value i of the integral term when the actual engine speed approaches to the target engine speed and goes beyond the target engine speed.

Referring to FIG. 3, the discrimination is made in step 34 as to whether or not I="1". When I="1", the operation moves to step 35, in which the calculation for controlling the position of the fuel regulating rack 4 in PI isochronous control so as to obtain the target engine speed No is carried out by the use of the initial value set in step 33 to produce a first target rack position data RD indicating the target position of the fuel regulating rack 4 for PI isochronous control. The determination in step 34 becomes NO when the execution of PI isochronous control is not requested, and the operation moves to step 42, wherein a second target rack position data RL indicating the target position of the fuel regulating rack 4 for controlling the fuel regulating rack 4 in the case of the use of a minimum-maximum speed type governor characteristics is calculated in accordance with the actual engine speed and the amount of operation of the accelerator pedal 10. After this, the operation moves to step 40.

Figure 5:
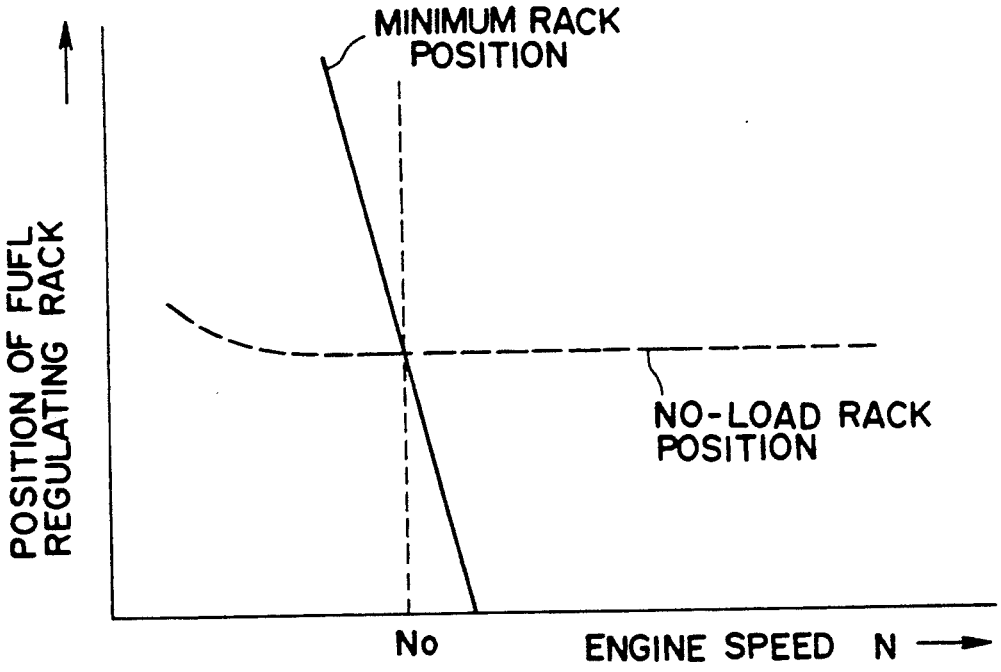
FIG. 5 is a graph showing characteristics of a minimum rack position and a no-load rack position.

The discrimination is made in step 36 as to whether or not the flag DF is set. The determination in step 36 becomes YES when the flag DF is set, and the operation moves to step 37. In step 37, a set of minimum rack position characteristic as illustrated in FIG. 5 calculated, which includes the no-load rack position at the time the rotational speed of the engine is equal to the target rotational speed No. In the next step 38 the minimum rack position RM at that time according to the minimum rack position characteristics is compared with the rack position data RD.

The minimum rack position characteristic is defined as a characteristic indicating the minimum rack position necessary for preventing the occurrence of the undershoot condition in the case where the isochronous control is carried out with the rack positioned at its no-injection position until the actual engine speed becomes equal to the target engine speed and the value of no-load rack position is set as the value of the integral term.

The determination in step 38 becomes NO when RM is greater than or equal to RD, and the operation moves to step 39 wherein the value of RM is set as the contents of the data RD. Then, the operation moves to step 40. As described above, the occurrence of undershoot is effectively prevented by the establishment of the minimum rack position characteristics. On the other hand, if it is discriminated in step 38 that RM is smaller than RD, the determination in step 38 becomes YES and the operation moves to step 40 without the execution of step 39.

The maximum position of the fuel regulating rack 4 in the direction for increasing the fuel quantity is calculated in step 40, and a rack position date obtained before step 40 is limited in such a way that the data never indicates a position greater than the maximum position. The rack position control or the fuel control is carried out in step 41 by the speed control signal CS produced in accordance with the first or second target rack position data obtained as described above. The operation then returns to step 31 after the execution of step 41 is terminated.

According to the arrangement described above, when engine speed control of the diesel engine 2 according to a PI isochronous control is requested by the control unit 8, it is discriminated whether or not the difference between the target engine speed No and the actual engine speed Na is greater than a predetermined value, which can be determined appropriately (for example, 200 (rpm) is employed in this embodiment), and the initial value of the integral term for PI control is determined on the basis of the result of the discrimination concerning the speed difference and the conditions of the flags DF, UF. When the actual engine speed has become substantially equal to the target engine speed by the PI control including the integral term determined as described above, the value according to the no-load rack position is set as the value i of the integral term, whereby the occurrence of a large overshoot or undershoot can be suppressed.

In order to assure the desired response and stability characteristics, since the value i of the integral term is determined in relation to the difference between the actual and target engine speeds without correction of the target engine speed, no matching process for PI control is needed even if the conventional PI control mode is employed for the engine speed control. As a result, a simple adjustment process may be realized and the control ability may be improved remarkably.

In this embodiment the value of the no-load rack position is employed as the value i of the integral term when the actual engine speed has become substantially equal to the target engine speed. However, gradual change in the value i of the integral term for PI control can be started before the time the actual engine speed has become substantially equal to the target engine speed, so that the value i of the integral term has just become equal to the value of the no-load rack position required for the engine speed at that time when the actual engine speed has just reached the target engine speed.

What is claimed is:

1. A method for controlling a rotational speed of an internal combustion engine in which a target position of a fuel regulating member for regulating a fuel quantity to be supplied to the engine is calculated in response to a given target engine speed and an actual engine speed of the internal combustion engine, said target position being necessary for making the actual engine speed equal to the target engine speed by a PI isochronous control, said method comprising:

a first discriminating step for discriminating whether or not a difference is more than a prescribed value;

an initial value determining step for determining an initial value of an integral term for the PI isochronous control on the basis of the difference between the target engine speed and the actual engine speed when it is discriminated that the difference between the target engine speed and the actual engine speed has changed by more than the prescribed value in response to said first discriminating step;

a second discriminating step for discriminating whether or not the actual engine speed is made substantially equal to the target engine speed by the PI isochronous control carried out by the use of the initial value determined in said initial value determining step; and a step for changing a value of the integral term to a value substantially equal to a value of a no-load rack position of the fuel regulating member at which a fuel quantity necessary for maintaining the rotational speed of the engine with no-load at the target engine speed is supplied to the engine, when it is discriminated in said second discriminating step that the actual engine speed is made substantially equal to the target engine speed.

2. A method as claimed in claim 1, wherein said initial value determining step has a step for discriminating whether or not the target engine speed is higher than the actual engine speed and a step for determining the initial value of the integral term depending upon whether or not the target engine speed is higher than the actual speed engine.

3. A method as claimed in claim 2, wherein the value of the no-load rack position is set as the initial value of the integral term when the target engine speed is higher than the actual engine speed.

4. A method as claimed in claim 2, wherein zero is set as the initial value of the integral term when the target engine speed is lower than the actual engine speed.

5. A method as claimed in claim 1, wherein, in the case where the actual engine speed is higher than the target engine speed, minimum control position characteristics are calculated, said minimum control position characteristics indicating a relationship between the rotational speed of the engine and the minimum position of the fuel regulating member for positioning the fuel regulating member at a no-load rack position when the actual engine speed is made equal to the target engine speed, and the position of the fuel regulating member is controlled not so as to become smaller than the minimum control position at each instant according to the minimum control position characteristics.

* * * * *

UNITED STATES PATENT AND TRADEMARK OFFICE

CERTIFICATE OF CORRECTION

PATENT NO. : 5,299,539

DATED : April 5, 1994

INVENTOR(S) : KAZUMASA KURIHARA

It is certified that error appears in the above-identified patent and that said Letters Patent is hereby corrected as shown below:

Column 7, line 35, after "difference" insert --between the target engine speed and the actual engine speed--.

Signed and Sealed this

Sixteenth Day of August, 1994

Bruce Lehman

*Attest:*

BRUCE LEHMAN

*Attesting Officer*

*Commissioner of Patents and Trademarks*